United States Patent [19]

Guillerm et al.

[11] 4,013,108

[45] Mar. 22, 1977

[54] APPARATUS FOR CUTTING VARIOUS MATERIALS

[75] Inventors: Jean Guillerm, Saint Maur; Jacques Fondronnier, Creteil, both of France

[73] Assignee: Centre Technique du Bois, Paris, France

[22] Filed: Sept. 29, 1975

[21] Appl. No.: 617,835

[30] Foreign Application Priority Data

Oct. 8, 1974 France ..... 74.33860

[52] U.S. Cl. ..... 144/175; 144/2 R; 144/162 R; 144/209 R; 144/242 R

[51] Int. Cl.[2] ..... B27L 5/00

[58] Field of Search ..... 83/4, 703, 704, 411 R, 83/422, 733; 144/175, 209 R, 162 R, 155, 2 R, 242 R, 177, 193 R

[56] References Cited

UNITED STATES PATENTS

| | | | |
|---|---|---|---|
| 63,128 | 3/1867 | Wilson | 144/177 |
| 3,223,568 | 12/1965 | Alderfer | 83/4 UX |
| 3,512,562 | 5/1970 | Norlander et al. | 144/193 R |

*Primary Examiner*—Frank T. Yost
*Attorney, Agent, or Firm*—DeLio and Montgomery

[57] ABSTRACT

The invention relates to a process and an apparatus for cutting various materials and more specifically pieces of wood.

The apparatus according to the invention, comprises a table and a pressure plate between which is held a piece of wood to be cut. The said table and the said plate are supported by a drum connected to a rotary driving device, equipped with radial forward movement devices. The cutting device also comprises a cutting tool installed in such a way that its knife acts on the piece of wood in accordance with a constant cutting radius.

The process and apparatus of the invention are applicable to the cutting of various materials and more particularly pieces of wood, with a view to obtaining thin planar products, calibrated in thickness, of excellent quality and of perfect appearance.

6 Claims, 7 Drawing Figures

R
II
III

APPARATUS FOR CUTTING VARIOUS MATERIALS

BACKGROUND OF THE INVENTION

The present invention relates to a process and an apparatus for cutting various materials and more specifically pieces of wood with a view to obtaining thin products of varying thickness.

With reference to wood two methods are at present used, planar cutting and spiral unrolling.

The former method consists of splitting the wood by means of a perfectly ground wedge, called a splitter, by producing a planar displacement between them. It concomitantly comprises pressing the wood by means of a pressure bar which is suitably positioned in front of the splitter, this bar preventing an anarchic separation by maintaining the progression of the split in the intervention plane of the cutting edge of the said splitter.

During cutting the wood undergoes a deforming stress, the outer surface of the cut product being compressed, whilst its so-called open surface corresponding to the separation is distended. In the case of thin veneers (between 2/10 and 15/10 mm), this deformation is scarcely visible. However, it remains in existence and is generally accentuated during drying when the thickness is at least equal to 2 mm. Moreover, the tendency towards the product assuming a concave configuration is often aided by the presence of splits parallel to the fibres on the open surface.

This concave configuration of the cut products and the presence of splits represent serious disadvantages which can even compromise the use of these products.

The unwinding method comprises splitting and pressing as hereinbefore but in this case the piece of wood is rotated and the splitter and pressure bar are moved radially, being positioned tangentially in order to act. Thus, during unwinding a spiral split having a constant pitch is produced.

The wood undergoes a deforming stress comparable to that noticed during cutting. However, this stress is less accentuated but evolves during winding as a function of the decrease in the radius of curvature. There is still a tendency towards a concave configuration and it is not constant over the entire length of the unwound product.

Moreover, the larger the radius of curvature of the piece of wood the more easily thick veneers can be unwound. Thus, it is much more difficult if not impossible in numerous cases to develop a thick veneer from a small radius unwinding without cracks occurring on the open surface.

However, these cracks, whose number and depth vary constitute surface gaps impairing the appearance, reducing the strength of the product and aiding the tendency towards a concave configuration.

Finally, unwinding does not make it possible to develop the whole piece of wood. To bring about the driving of the piece, it is in fact necessary to leave a residual core or the like, the latter being larger proportionately with the length of the piece, proportionately with the greater thickness of the unrolled products, proportionately with the greater resistance of the wood, etc.

A special unwinding machine is described in German Pat. No. 932,160, but would not appear to have been exploited. This machine comprises a rotor equipped with a knife and a pressure bar passing in front of the pieces of wood which extend to the outside (from the side opposite to the rotation axis), being moved towards the said rotor. The cutting radius is therefore constant but the end of the piece of wood during cutting is concave and the corresponding surface of the cut product convex. Thus, this product once again has a concave configuration and this is accentuated under the action of both the pressure bar and the cutting stress. Moreover, the said product inevitably has cracks which tend to open when an attempt is made at straightening. Finally, the cutting radius cannot be regulated.

BRIEF SUMMARY OF THE INVENTION

The object of the present invention is to obviate the above-indicated disadvantages of planar cutting and unwinding.

To this end, the process comprises imparting a relative circular movement, whose radius remains constant throughout the cutting of the material, between the material to be cut and the cutting tool. According to the invention the part of the material to be cut is placed between the geometrical axis of the circular movement and the cutting tool so that the end surface of this material is convex and the corresponding surface of the product is substantially planar, the said material is presented in such a way that the general direction of its fibres are substantially parallel to the cutting edge of the cutting tool which is itself parallel to the above-mentioned geometrical axis, in per se known manner this material is fed from the said geometrical axis towards the said cutting edge during successive cutting passes and the distance between the said axis and the said cutting edge is regulated until the constant radius of curvature is perfectly adapted to the production of planar cut products.

Therefore, as a result of this process it becomes possible to:

cut thick products whose thickness is at least equal to 2 mm, prevent the concave configuration, obviate the irreducible disadvantages of unwinding small diameter cores, select in each case the optimum value for the cutting radius in such a way that the cut products are planar and have no cracks on the open surface, process wood having a small cross-section which cannot systematically undergo conventional unwinding, orientate the prior cutting of the wood by sawing so as to obtain the selected esthetic and decorative grain effect as is the case in cabinet making, permit the more advantageous use of small wood having certain mechanical, technical or esthetic qualities but whose cutting by sawing gravely comprimises the quantitative yield.

The invention also extends to an apparatus for performing this process comprising two pieces of equipment, on the one hand a cutting tool comprising a knife and a pressure bar, and on the other a support for receiving the material to be cut, one piece of equipment being mounted so as to pivot about a geometrical axis remote from the cutting edge of the knife corresponding with the constant cutting radius selected and connected to a drive unit which gives to it a rotational movement in accordance with an amplitude at least equal to the angular opening of the material to be cut, the equipment supporting the material being also connected to a feed device moving it towards the knife as a function of the thickness of the products to be cut.

According to the invention this material supporting equipment is mounted from the cutting tool towards the geometrical pivoting axis, whereby its feed device is directed radially and the device has means for regulating the distance between the geometrical axis and the cutting edge.

According to a particularly advantageous embodiment the device comprises a drum which can be continuously rotated and which supports the material to be cut. According to the invention the drum is equipped with a table and a pressure plate which applies the said material to be cut against the latter, the said table and the said plate extending substantially parallel to a radial plane of the drum, whereby at least one of the members formed by the said table and the said plate is equipped with the feed device and wherein the cutting tool is immobilised on a fixed frame so that the distance between the cutting edge and the drum rotation axis is equal to the constant cutting radius.

BRIEF DESCRIPTION OF THE DRAWINGS

Other and further objects of the present invention will be apparent from the following description and claims and are illustrated in the accompanying drawings, which by way of illustration show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the scope of the appended claims. In the drawings:

DETAILED DESCRIPTION OF THE PREFERRED EMBODIMENT

Figures 1, 2:
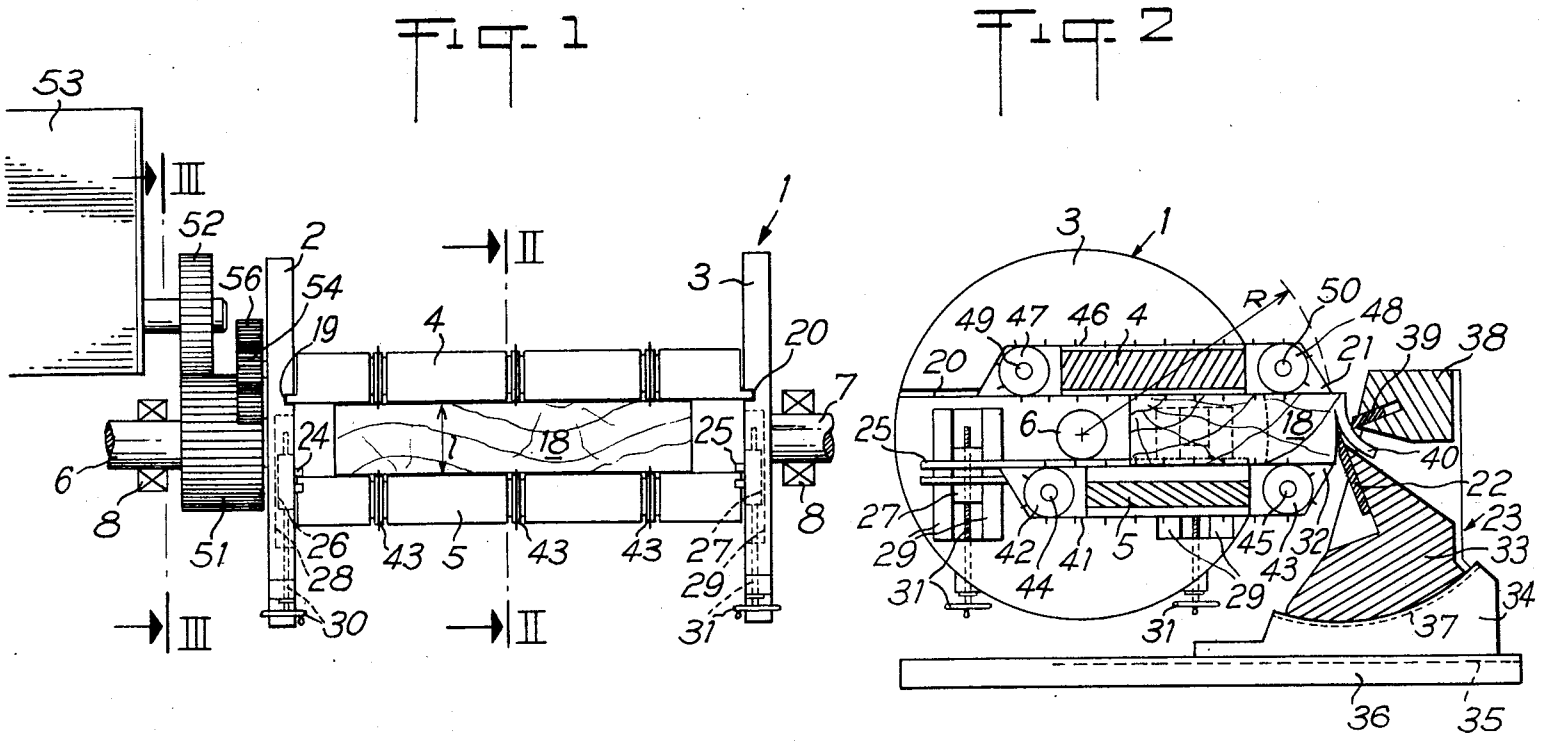
FIG. 1 is a partial front elevation, the cutting tool being removed, of a first embodiment of the apparatus according to the invention.
FIG. 2 is a schematic cross-section along the line II—II of FIG. 1.
Figure 3:
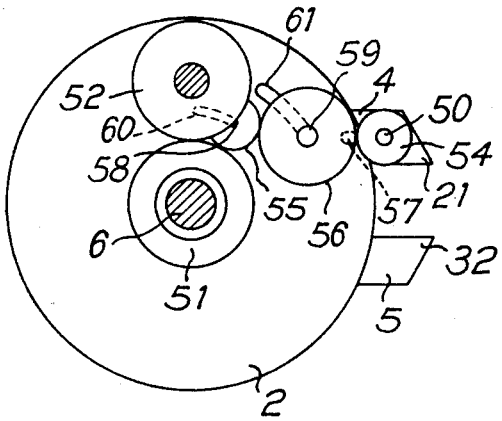
FIG. 3 is another schematic cross-section along the line III—III of FIG. 1.
Figure 4:
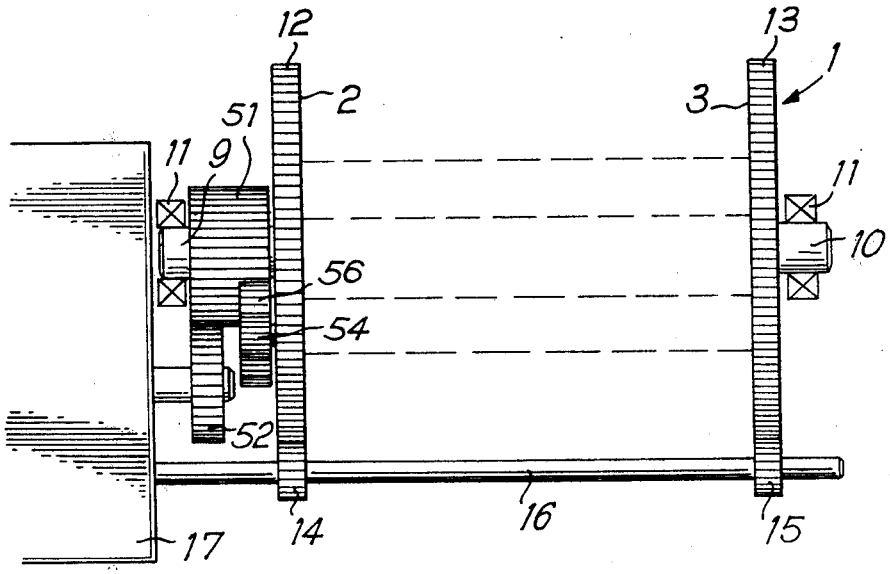
FIG. 4 is a view analogous to FIG. 1 only showing the means used according to a variant of the mode of driving the drum.

As clearly shown in FIGS. 1 to 4, the apparatus comprises, according to the first embodiment, a drum 1 comprising two circular side plates 2, 3 connected by a support table 4 and a pressure plate 5.

The drum can be continuously rotated. To this end, and according to the embodiment shown in FIG. 1, side plates 2, 3 are integral with co-axial shafts 6, 7 supported by bearings 8, at least one of these shafts being coupled to a drive unit. According to the embodiment of FIG. 4, side plates 2, 3 are integral with co-axial journals 9, 10 supported by bearings 11 and having peripheral toothed rims 12, 13 meshing with pinions 14, 15 keyed on a shaft 16 coupled to a drive unit 17.

Table 4 and plate 5 extend parallel to a radial plane of the drum 1 and constitute a support for each piece of wood 18 which has been previously sawed and placed between them, whereby they hold it in place, rotate and radially advance it.

Table 4 is guided in longitudinal guides 19, 20 provided in side plates 2, 3 so as to be able to bring its peripheral reaction edge 21 as near as possible to knife 22 of cutting tool 23, the latter being positioned in the manner described hereinafter as a function of the selected and maintained constant cutting radius R. When the table is in place it is rigidly fixed to the side plates, e.g., by means of screws not shown on drawing.

Analogously plate 5 is guided in longitudinal guides 24, 25 carried by slides 26, 27, themselves guided in transverse guides 28, 29 of side plates 2, 3 and connected to regulating devices 30, 31 such as nut-screw systems. By manipulating devices 30, 31 the distance of plate 5 from table 4 is regulated corresponding to the width $l$ of pieces of wood 18 and by displacing plate 5 along guides 24, 25 its reaction edge 32 is brought onto the same arc concentric to shafts 6, 7 as the reaction edge 21 of the table. When these settings have been made plate 5 is locked on slides 24, 25 by means, for example, of screws and devices 30, 31 or immobilized by means, for example, of bolts.

The cutting tool 23 comprises a support 33 whereon is mounted knife 22 and whose inclination is regulatable relative to a carriage 34 which is displaceable in translation along a guide 35 of a fixed frame 36. As this guide extends parallel to the plane passing through the rotation axis of drum 1 and through the cutting edge of knife 22 the cutting radius R is regulated by displacing carriage 34 because in this way the knife 22 is moved towards or away from the said rotation axis. Moreover, by pivoting support 33 on carriage 34, which in the embodiment shown is obtained by moving this support in a curved guide 37 centred on the theoretical location of the cutting edge of knife 22, the clearance angle of the knife relative to the outer cylindrical surface of the piece of wood 18 is regulated in such a way that the optimum cutting conditions are obtained.

The cutting tool 23 also comprises a support 38 in which a pressure bar 39 is mounted and which is regulatable relative to carriage 34 in such a way that it is possible to define the position of the said bar relative to the knife. Thus, as its cutting angle is fixed, it is possible to regulate the width of passage between bar 39 and knife 22, whereby this width is less than the thickness of the product 40 to be cut. It must also be possible to regulate the distance which separates the edges of the bar and the knife, in projection on a tangential plane.

The apparatus of the invention is also equipped with means permitting the advance of the piece of wood 18 on each rotation of drum 1 by a radial length substantially equal to the thickness of the products 40 to be cut.

In the embodiment shown endless barbed chains 41 are integrated in plate 5. They extend in longitudinal planes perpendicular to the rotation axis and are equidistantly distributed from one another in the space separating side plates 2, 3 in such a way as to be able to take any piece of wood 18, whatever its length. At their ends they are wound onto toothed wheels 42, 43 keyed on shafts 44, 45. These shafts are supported by not shown elastic bearings located in plate 5 at locations such that the covering of the active sides of the chains 41 is spaced from the said plate. Thus, this covering forms a flexible pressure blanket acting directly on the piece of wood 18.

Analogously the endless barbed chains 46 are integrated in table 4 and positioned facing those mentioned hereinbefore. At their ends they are wound onto toothed wheels 47, 48 keyed on shafts 49, 50. These shafts are supported by not shown bearings precisely positioned in table 4 in such a way that only the barbs of the active sides of the chains project therefrom and the corresponding surface of the table constitutes a positive support and reference element for the piece of wood 18.

Whilst in the represented embodiment the chains 41 of the plate are free, the chains 46 of the table are driving and to this end shaft 50 is connected to a drive device to be described hereinafter.

This drive device comprises a central toothed wheel 51 which idles about shaft 6 of drum 1. Upstream it meshes with the output pinion 52 of a variable speed rotational drive unit 53. Downstream it is connected to a driven pinion 54 via a gear train 55, 56. The driven pinion 54 is coupled to the free end of shaft 50 which traverses a slot 57 made in side plate 2 so as to permit the longitudinal regulation of table 4. Gears 55 and 56 idle about shafts 58, 59 which traverse curved openings 60, 61 made in side plate 2 concentric to shaft 6, whereby shafts 58, 59 can be immobilized after regulation by any appropriate means such as a nut.

When drum 1 is stopped to regulate the longitudinal position of table 4 it is necessary to unlock shafts 58, 59 and move gear train 55, 56 away from pinion 54 by moving these shafts into openings 60, 61. Then, when the selected position is reached and the table is immobilized gears 55, 56 are meshed with one another and with pinion 54.

When drum 1 is rotated either by shafts 6, 7 (FIG. 1) or by pinions 14 (FIG. 4) group 53 (FIG. 1) or 17 (FIG. 4) simultaneously rotates toothed wheel 51. If the angular speed of the latter is equal to that of the drum, gear train 55, 56 transmits no movement to pinion 54 and chains 46 do not circulate so that the piece of wood 18 remains stationary relative to table 4 and plate 5. If, however, toothed wheel 51 rotates more quickly than the drum it brings about the rotation of pinion 54 in a direction such that the piece of wood 18 advances and if it rotates less quickly it causes the said piece of wood to move back.

It is important to note that the radial displacement of the piece of wood during its rotation is continuous. This leads to the advantage of obtaining products 40 having a strictly constant thickness whilst maintaining an also constant instantaneous cutting radius. Thus, if the piece of wood 18 advances step by step and is therefore stationary relative to the drum during each cutting operation, two successive cuts have the shape of two identical circular arcs staggered by translation along the median radius by a length equal to the thickness of product 40. Thus, the thickness of the product measured at the ends of the arcs is less than the thickness measured in the centre. This difference is negligible if the width 1 of piece 18 is relatively small but becomes unacceptable if this width is relatively large and if the products 40 have to be perfectly calibrated as regards thickness. However, if piece 18 advances continuously two successive cuts are spiral arcs having a constant instantaneous radius of curvature and which correspond to a constant point by point translation in such a way that the thickness of the products 40 is strictly uniform.

Obviously the regulation of the distance between table 4 and plate 5 can be performed symmetrically relative to the rotation axis instead of solely from the plate. In this case it is merely necessary to mount longitudinal guides 19, 20 on slides guided along the same transverse guides 28, 29 as slides 26, 27 and to connect the table guides and plate guides to a symmetrical control device, such as of the type comprising screws of opposite pitch.

Obviously the chains 46 of the table could be free and it would then be chains 41 of the plate which would be driving. There is in fact nothing to prevent all the chains being driving, provided that they are perfectly synchronous.

Finally, the device controlling the advance of the chains can be of another type, constituted, for example, by a motovariator group carried by one of the side plates of drum 1, coupled to at least one of the chain drive shafts and supplied from a central collector.

The first embodiment of the apparatus, described hereinbefore with reference to FIGS. 1 to 4, functions in the following way. With a piece of wood 18 pressed by plate 5 against table 4 drum 1 is rotated and chains 41, 46 are driven by the feed device. During each revolution piece 18 encounters cutting tool 23 whose pressure bar 39 compresses the wood and whose knife 22 cuts a product 40 in accordance with a radius of curvature which is the same as in the previous revolution and which will be the same in the following revolution. This embodiment has numerous subsidiary advantages.

In particular the apparatus can be adapted to a conventional unwinding means or can be constructed entirely in a new form, benefiting from the experience obtained in this field.

As the carriage 34 is static it is extremely easy to intervene at any time, without stopping the drum 1, relative to the means for regulating knife 22 and pressure bar 39, so as to complete the cutting of the wood.

Moreover, as supports 33 and 38 are stationary during cutting the removal of products 40 as they are cut and their reception cause no difficulty, being performable in a fixed station.

According to the first embodiment described with reference to FIGS. 1 to 4, the circular cutting apparatus having a constant radius performs a continuous rotary movement.

Figure 6:
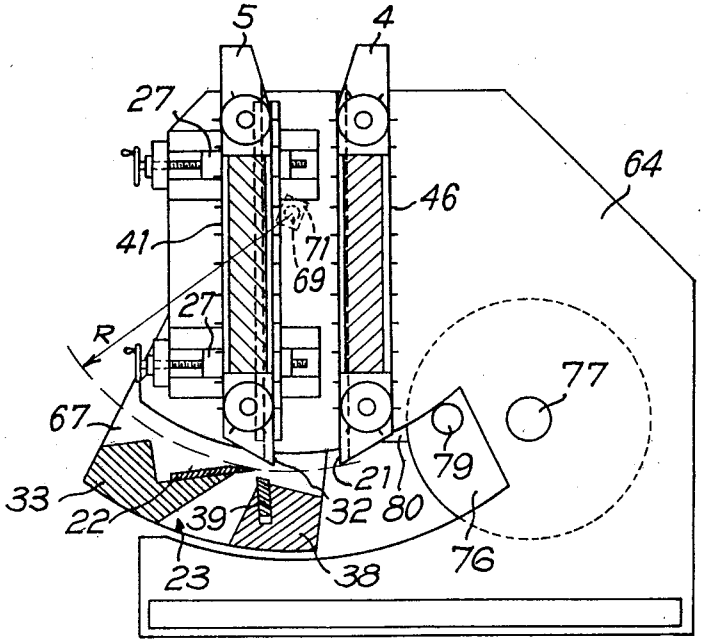
FIG. 6 is a median cross-section parallel to the plane of FIG. 5.
Figure 5:
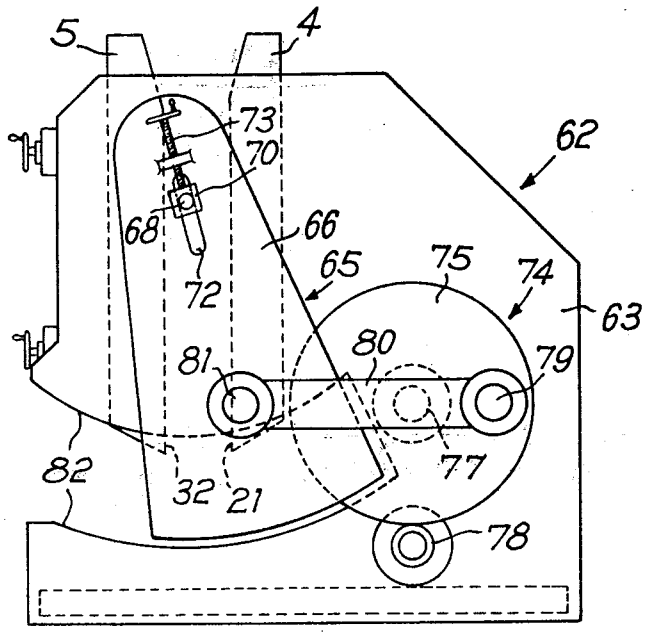
FIG. 5 is a side elevation showing a second embodiment of the apparatus of the invention.
Figure 7:
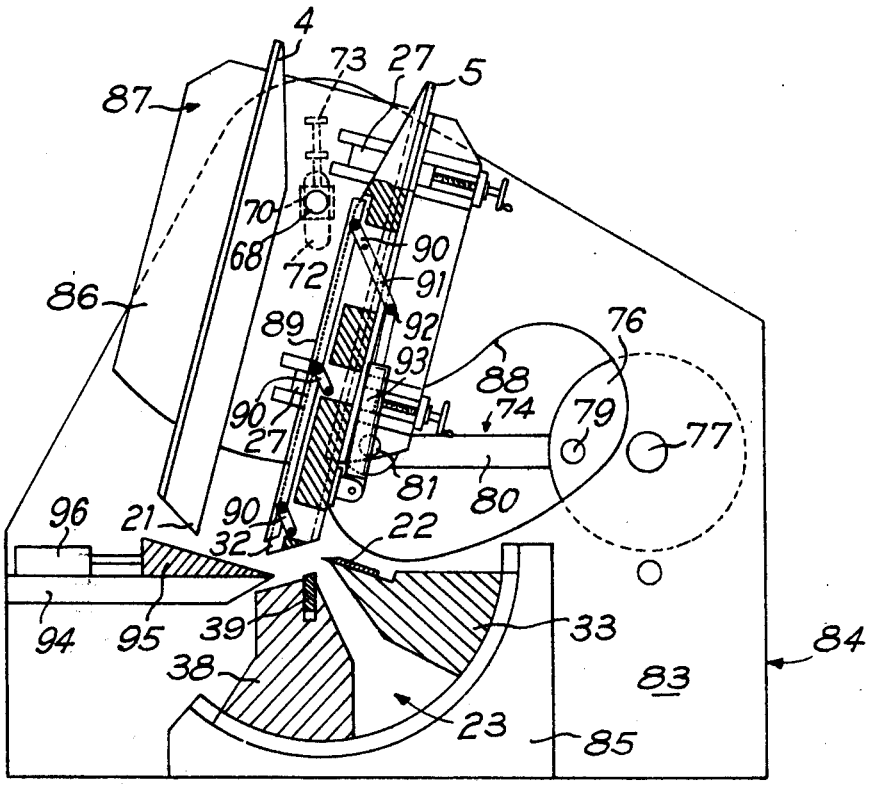
FIG. 7 is an analogous view to FIG. 6 showing a third embodiment of the apparatus according to the invention.

It can also, however, perform an alternating pivotal movement, whereof two embodiments are illustrated by FIGS. 5 to 7.

According to the second embodiment of FIGS. 5 and 6, the cutting apparatus of the alternating pivotal type comprises a fixed frame 62 having two side plates 63, 64 between which are mounted a table 4 and a pressure plate 5 by means analogous to those described hereinbefore for regulating the position of the reaction edges 21 and 32 and for the spacing. Table 4 and plate 5 are also equipped with feed chains 46 and 41 arranged in the same way as in the previous embodiment but whose driving shaft is connected to a simpler driving device, such as a type comprising a ratchet wheel and a pawl, the latter being operated by a rod/crank handle system driven by a motovariator group.

The cutting apparatus also comprises a beam 65 having two arms 66 and 67 extending externally of side plates 63, 64. At their end adjacent to the reaction edges 21 and 32 of table 4 and plate 5 the arms are connected by support 33 of knife 22 and support 38 of pressure bar 39, the said supports being adjustable as hereinbefore, although this is not shown in the drawings. These arms are also pivotally mounted at their opposite ends relative to frame 62 about a geometrical axis extending between table 4 and plate 5 parallel to their supporting surfaces and perpendicular to side plates 63, 64. To regulate the cutting radius it must be possible to modify the distance separating this geometrical axis from the cutting edge of knife 22.

In the embodiment shown the geometrical pivot axis is materialised by two journals 68, 69 integral with the fixed side plates 63, 64 and co-operating with bearings 70, 71. Each bearing is slidingly mounted in an opening 72 made in the corresponding arm 66 or 67 of the beam and is connected to a regulating device 73, e.g., of the nut-screw type, permitting the movement of the bearing in question relative to the arm, and consequently the movement of knife 22 towards or away from the geometrical axis of journal 68, 69.

The same result can be obtained by incorporating the bearings in the side plates of the frame and then guiding the journals in translation on the arms of the beam and coupling them to the regulating device.

It is also possible to definitively fix the journals and bearings on the side plates and arms, it then being merely necessary to mount supports 33 and 38 on a carriage displaceable along the arms.

In any case when regulating the cutting radius R by acting on devices 73, it is also necessary to regulate the position of table 4 and pressure plate 5 along guides 20 and 25, so that reaction edges 21 and 32 are located as close as possible to the cylindrical surface swept by the cutting edge of knife 22.

Finally, the cutting device has an actuating device 74 giving an alternating pivotal movement to beam 65. In the embodiment shown this device 74 comprises two flywheels 75, 76 keyed onto a shaft 77, supported by the bearings equipping side plates 63, 64 of the frame. Flywheel 75 is peripherally toothed and meshes with a motive pinion 78. Each flywheel is equipped with an off-centre crank pin 79 aligned with that of the other flywheel. A rod 80 pivots about each crank pin and the other end of rod 80 is articulated about a shaft 81 integral with the corresponding beam arm. Thus, each flywheel is positioned between a frame side plate and a beam arm, whereby the corresponding rod travels outside the latter.

When flywheels 75, 76 are continuously rotated it is obvious that the beam alternately pivots between an extreme pre-cutting position (FIG. 6) and an extreme post-cutting position (FIG. 5). During the active travel, corresponding to pivoting between the position of FIG. 5 and that of FIG. 4, knife 22 cuts a thin product 40 in the piece of wood 18. However, during the return travel, corresponding to pivoting between the position of FIG. 4 and that of FIG. 5 the knife must not meet the piece of wood. For this reason the device for driving the feed chains 46, 41, integrated with table 4 and plate 5 is of the intermittent type, so that there is a stoppage period as soon as cutting commences. If it is desired that the piece of wood advances during cutting so as to obtain a uniform thickness of the product it is then necessary for this driving device to control the return of the piece before the beam starts its return travel. This can easily be obtained by means of cams.

Obviously the eccentricity of crank pin 79 can advantageously be adjustable, more particularly for adapting the circular travel of the beam to the width *l* of pieces 18. In this case it is necessary to envisage regulating at the same time the said eccentricity and the position of the slides 27 carrying plate 5.

In the embodiment illustrated by FIGS. 5 and 6 the mean position of beam 65 is vertical, which necessitates making a passage 82 for cutting tool 23 in side plates 63, 64 of frame 62.

In actual fact this mean position can also be horizontal, provided that the arms of the beam are provided with a balancing mass. The cut products can then be more easily removed by gravity. The frame can also be more robust because it has no opening, but the power consumed is less regular and slightly higher.

The mean position of the beam can also be inclined so as to combine the advantages of the two previous positions.

According to a third embodiment, shown schematically in FIG. 7, the cutting device of the alternating pivoting type comprises, as in the previous case, a fixed frame and a beam.

However, in this embodiment the two side plates 83 of frame 84 are connected by a cross-member 85, whereon are mounted in adjustable manner support 33 of knife 22 and support 38 of pressure bar 39.

Reciprocally, the two arms 86 of beam 87 support a table 4 and a pressure plate 5 via the same means, permitting the adjustment of their spacing as well as of the position of their reaction edges 21 and 32.

The same conjugate pivoting members are used, but in view of this inverted arrangement, according to which the cutting tool 23 is fixed whilst the wood-taking equipment 4, 5 pivots, one of the said pivoting members is integral with the beam instead of being integral with the frame.

In the embodiment shown, each journal 68 is integral with the corresponding beam arm 86 and co-operates with a bearing 70 which slides in an opening 72 made in the side plate 83 of the contiguous frame. This bearing is connected to a regulating device 73, e.g., of the nut-screw type, permitting the displacement of the bearing in question relative to the frame and thus the movement towards or away from knife 22 of the pivot axis materialised by journal 68.

The actuating device 74 is again used which makes it possible to give an alternating pivoting movement to beam 87. However, in this case each flywheel 76 is placed, externally of frame 84, between the corresponding side plate 83 and rod 80, whereby shaft 81 traverses an opening 88 in this side plate to connect the contiguous arm 86 of the beam to the end of rod 80, opposite to that pivoting about crank pin 79.

This third embodiment has the advantage of permitting a continuous feed of pieces of wood relative to beam 87 and the feeding by gravity of these pieces towards knife 22. It is merely necessary to hold the pieces during cutting and positively define their forward movement when they are beyond the intervention zone of the knife. To this end table 4 and plate 5 have no barbed chains. However, the said plate is equipped with pressure guide bars 89 arranged parallel to one another and preferably to the forward movement direction of the material to be cut. Each guide bar 89 is connected to plate 5 by links 90 which are of equal length and parallel to one another. One of the links of the guide bar in question is extended by a lever 91 traversing plate 5 and which, by means of a pin 92, is made integral with the levers of the other guide bars, whereby this pin is coupled to a jack, 93 supported on the plate. Thus, by operating the jack guide bars 89 are moved parallel to one another towards table 4 in order to compress the pieces of wood 18 during their cutting, or alternatively away from the said table to free the said pieces when they are moving forward by gravity.

Moreover, the side plates 83 of frame 84 are connected by a cross-member 94 extending in front of the cutting tool 23. On the said cross-member is slidingly mounted a stop 95 in the form of a wedge, controlled by a regulating member 96 and located facing the free space existing between table 4 and plate 5, when beam 87 is located in the end of travel pre-cutting position (FIG. 7) and the guide bars 89 of this plate are at the maximum spacing from the table, thus freeing the pieces of wood.

As member 96 is regulated so that stop 95 occupies a position corresponding to the chosen thickness of the products 40 to be cut, when beam 87 reaches the position shown in FIG. 7, jack 93 brings about the spacing apart of guide bars 89. Thus, the pieces of wood 18 drop until they are in contact with stop 95 and jack 93 acts in the opposite direction so that the guide bars 89 press these pieces of wood against the table, whilst maintaining them in place. Beam 87 pivots towards cutting tool 23 in passage and pressure bar 39 compresses the wood. Then, knife 22 cuts a thin product. The beam returns and at the end of travel guide bars 89 again move apart.

Obviously, in this third embodiment table 4 and pressure plate 5 can be equipped as in the other cases with feed devices in the form of barbed chains whereby the guide bars 89 and stop 95 then become superfluous.

The invention is not limited to the embodiments described and represented hereinbefore, various modifications being possible thereto without passing beyond the scope of the invention.

The process and apparatus of the invention are applicable to the cutting of various materials and more particularly pieces of wood with a view to obtaining planar thin products, calibrated in thickness, of excellent quality and of perfect appearance.

We claim:

1. An apparatus for cutting various materials and more particularly pieces of wood with a view to obtaining thin products of various thicknesses, comprising two pieces of equipment, on the one hand a cutting tool comprising a knife and a pressure bar, and on the other a support for receiving the material to be cut, said latter piece of equipment being mounted so as to pivot about a geometrical axis spaced from the cutting edge of the knife by a distance corresponding with the constant cutting radius selected and connected to a drive unit which gives to it a rotational movement in accordance with an amplitude at least equal to the angular opening of the material to be cut, the equipment supporting the material being also provided with a feed device operable to move the material towards the knife as a function of the thickness of the products to be cut, wherein this material supporting equipment is mounted from the cutting tool towards the geometrical pivoting axis the feed device of the supporting equipment being directed radially and the device having means for regulating the distance between the geometrical axis and the cutting edge.

2. An apparatus according to claim 1 comprising a drum which can be continuously rotated and which supports the material to be cut, wherein the drum is equipped with a table and a pressure plate which applies the said material to be cut against the table, the said table and the said plate extending substantially parallel to a radial plane of the drum, at least one of the members formed by the said table and the said plate being equipped with the feed device and wherein the cutting tool is immobilised on a fixed frame so that the distance between the cutting edge and the drum rotation axis is equal to the constant cutting radius.

3. An apparatus according to claim 2 whose drum has two side plates connected to a rotary drive device, wherein one of the side plates co-operates with a central independent toothed wheel meshing upstream with the output pinion of a drive unit for rotation at variable speed and downstream with at least one gear train idling on the said side plate, wherein the final gear of the train meshes with a driven control pinion of the corresponding feed device, this pinion being mounted on the same supporting member as the latter, namely the table or plate, and wherein the shafts of the gear train traverse concentric curved openings of the side plate and the shaft of the driven pinion traverses a slot in the said side plate so as to permit their angular displacement during the regulation of the table and the plate as a function of the cutting radius.

4. An apparatus according to claim 2 whose feed device comprises a system of endless chains wound onto toothed drive wheels, wherein the chains are equipped with barbs and their toothed wheels are keyed onto two shafts supported by the table or plate respectively, wherein solely the barbs of the chain project from this table so that the table constitutes a positive supporting member for the material to be cut, wherein the shafts of the plate chains are mounted in the latter via elastic supports in such a way that the covering of the active sides of these chains spaced from the supporting surface of the said plate forms a flexible pressure blanket for the material to be cut and wherein at least one of the shafts is connected to a driving device for controlling the forward movement.

5. An apparatus according to claim 2, wherein the cutting tool is slidingly mounted in per se known manner in guides of the fixed frame but solely for regulating the constant cutting radius and then co-operates with post-regulating cutting means, and wherein the table and plate are themselves slidingly mounted parallel to the material support planes in drum guides, being provided with blocking means for their regulation with a view to bringing them as close as possible to the knife.

6. An apparatus according to claim 5, wherein the table guides are carried directly by the material-carrying equipment, whilst the plate guides are carried via regulating members, permitting the determination of the spacing of the said plate relative to the said table as a function of the width of the materials to be cut.

* * * * *